US011705292B2

(12) United States Patent
Kawaguchi et al.

(10) Patent No.: US 11,705,292 B2
(45) Date of Patent: Jul. 18, 2023

(54) ELECTROMAGNETIC RELAY

(71) Applicant: OMRON Corporation, Kyoto (JP)

(72) Inventors: Naoki Kawaguchi, Kyoto (JP); Takeshi Nishida, Kyoto (JP); Kazuki Furukawa, Kyoto (JP); Takashi Tsukada, Kyoto (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/835,870

(22) Filed: Jun. 8, 2022

(65) Prior Publication Data

US 2022/0406547 A1 Dec. 22, 2022

(30) Foreign Application Priority Data

Jun. 17, 2021 (JP) ..... 2021-101220

(51) Int. Cl.
*H01H 9/30* (2006.01)
*H01H 9/44* (2006.01)

(52) U.S. Cl.
CPC ..... *H01H 9/30* (2013.01); *H01H 9/443* (2013.01)

(58) Field of Classification Search
CPC ..... H01H 9/30; H01H 9/443
USPC ..... 335/201
See application file for complete search history.

(56) References Cited

U.S. PATENT DOCUMENTS 4,421,959 A * 12/1983 Chen ..... H01H 9/38 200/243
5,546,061 A * 8/1996 Okabayashi ..... H01H 9/443 335/126
6,975,194 B2 * 12/2005 Nishida ..... H01H 51/2209 335/201
8,519,811 B2 * 8/2013 Sugisawa ..... H01H 1/54 335/201
2018/0182584 A1 * 6/2018 Iwamoto ..... H01H 50/14
2019/0035585 A1 * 1/2019 Minowa ..... H01H 50/546

FOREIGN PATENT DOCUMENTS

JP 2016-24864 A 2/2016

* cited by examiner

*Primary Examiner* — Alexander Talpalatski
(74) *Attorney, Agent, or Firm* — Shinjyu Global IP

(57) ABSTRACT

An electromagnetic relay includes a first fixed terminal including a first fixed contact, a second fixed terminal including a second fixed contact, a movable contact piece, a case, a drive device, and a first magnet. The movable contact piece includes a first movable contact and a second movable contact. The case includes an accommodation space and a side wall covering the accommodation space in a first direction. The first magnet extends an arc generated between the first fixed contact and the first movable contact in a second direction opposite to the first direction. The first fixed terminal includes a first end. The first end of the first fixed terminal includes a tapered portion inclined in the second direction from the first fixed contact toward the first magnet and that at least partially overlaps with the first magnet when viewed from a moving direction of the movable contact piece.

8 Claims, 6 Drawing Sheets

ELECTROMAGNETIC RELAY

This application claims priority to Japanese Patent Application No. 2021-101220, filed Jun. 17, 2021. The contents of that application are incorporated by reference herein in their entirety.

FIELD

The present invention relates to an electromagnetic relay.

BACKGROUND

In an electromagnetic relay, an arc occurs at the contacts when the current is cut off. As the arc elevates the temperature of the contacts, the contacts may melt and generate a hot gas containing metal vapor. If the hot gas stays in the vicinity of the contacts, the insulation performance between the contacts is degraded, and the arc may reignite. In order to prevent the re-ignition of the arc, the electromagnetic relay disclosed in Japanese Unexamined Patent Application Publication No. 2016-24864 includes an arc-extinguishing space, a gas inflow space separate from the arc-extinguishing space, and a gas passage, all disposed in a case, for allowing the hot gas to escape from the arc-extinguishing space into the gas inflow space.

SUMMARY

In the electromagnetic relay of Japanese Unexamined Patent Application Publication No. 2016-24864, the inlet and outlet of the gas passage are disposed in the vicinity of the contact. Thus, the hot gas easily returns to the contact through the gas passage. As the load capacity increases, the amount of hot gas returning to the vicinity of the contact also increases, which may cause the arc to reignite.

An object of the present invention is to reduce the possibility of re-ignition of an arc at a contact in an electromagnetic relay.

The electromagnetic relay according to one aspect of the present invention includes a first fixed terminal, a second fixed terminal, a movable contact piece, a case, a drive device, and a first magnet. The first fixed terminal includes a first fixed contact. The second fixed terminal includes a second fixed contact and is apart from the first fixed terminal. The movable contact piece includes a first movable contact facing the first fixed contact and a second movable contact facing the second fixed contact. The case includes an accommodation space where the first fixed contact, the second fixed contact, and the movable contact piece are accommodated, and a side wall covering the accommodation space in a first direction. The drive device moves the movable contact piece in moving directions including a direction in which the first movable contact approaches the first fixed contact and a direction in which the first movable contact separates from the first fixed contact. The first magnet is disposed laterally to the first fixed contact. The first magnet configured to extend an arc generated between the first fixed contact and the first movable contact in a second direction opposite to the first direction. The first fixed terminal includes a first end in the second direction. The first end of the first fixed terminal includes a tapered portion. The tapered portion is inclined from the first fixed contact toward the first magnet in the second direction, and at least partially overlaps with the first magnet when viewed from the moving directions of the movable contact piece. The case includes an arc extension space expanding in the second direction from the tapered portion and communicating with the accommodation space.

In the electromagnetic relay, an arc generated between the first fixed contact and the first movable contact is extended in the second direction. That is, the bright spot of the arc on the first fixed terminal moves to the first end. The bright spot of the arc that has moved to the first end is guided by the tapered portion at the first end, and easily moves to the back side of the first magnet, and also moves in the first direction. Thus, the arc can be significantly extended in the arc extension space expanding in the first direction from the tapered portion, so that the arc can be quickly cut off. As a result, the possibility of re-ignition of the arc generated between the first fixed contact and the first movable contact can be reduced.

The first fixed terminal may include a first external connecting portion protruding from the side wall in the first direction. The second fixed terminal may include a second external connecting portion protruding from the side wall in the first direction. In this case, in the electromagnetic relay in which an arc generated between the first fixed contact and the first movable contact is extended in the direction away from the first external connecting portion, the possibility of re-ignition of the arc generated between the first fixed contact and the first movable contact can be reduced.

The first magnet may include a magnet end in the second direction. The magnet end of the first magnet may be disposed in the second direction with respect to the first fixed contact. In this case, the arc is easily drawn to the magnet end of the first magnet, and thereby the arc can be quickly cut off in the arc extension space.

The first magnet may include a first surface in a third direction from the first fixed contact toward the second fixed contact and a second surface opposite the first surface. The tapered portion may protrude in the third direction from the first surface of the first magnet when viewed from the moving directions of the movable contact piece. In this case, the bright spot of the arc that has moved to the first end moves to the back side of the first magnet more easily.

The first magnet may include a first surface extending in a third direction from the first fixed contact toward the second fixed contact and a second surface opposite the first surface. The first end of the first fixed terminal may include a corner portion that is disposed near the second surface of the first magnet when viewed from the moving directions of the movable contact piece and that is connected to the tapered portion. In this case, the movement of the bright spot of the arc on the first fixed terminal can be stopped at the corner portion. Thus, the arc is limited from being too far from the movable contact piece. As a result, the phenomenon of re-ignition of the arc due to its interruption is less likely to occur.

The first end of the first fixed terminal may include a first flat portion and a second flat portion apart from the first flat portion. The tapered portion may be disposed between the first flat portion and the second flat portion. In this case, for example, when the first fixed terminal is fixedly press-fitted into the case in the second direction, the press-fitting of the first fixed terminal to the case is facilitated.

The drive device may include a spool and a fixed iron core disposed inside the spool and in the second direction with respect to the first fixed terminal. The spool may include a collar portion configured to provide an insulating distance between the first fixed terminal and the fixed iron core. The collar portion of the spool may be disposed in a third direction extending from the first fixed contact toward the second fixed contact with respect to the first magnet. In this case, the arc is retained from hitting the collar portion, enhancing the durability of the collar portion. Further, extension of the arc is less likely to be hindered by the collar portion, and thereby the arc can be quickly cut off in the arc extension space.

The electromagnetic relay may further include a second magnet disposed opposite the first magnet and laterally to the first fixed contact. The second magnet may be configured to extend an arc generated between the second fixed contact and the second movable contact. The collar portion of the spool may be positioned between the first magnet and the second magnet when viewed from the moving directions of the movable contact piece. In this case, the arc can be quickly cut off in the arc extension space while securing the distance for insulation between the first fixed terminal and the fixed iron core and between the second fixed terminal and the fixed iron core.

DETAILED DESCRIPTION

Figure 1:
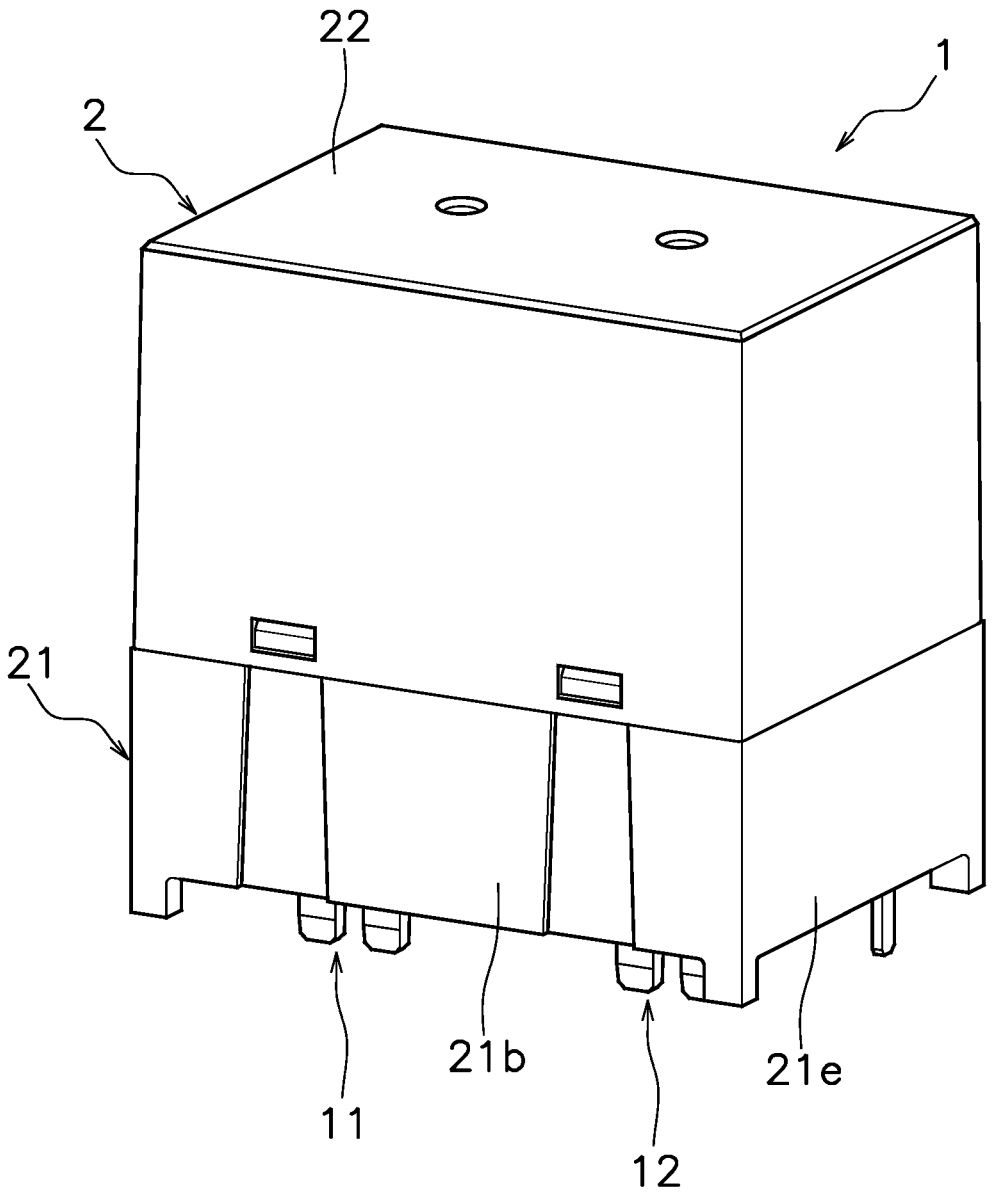
FIG. 1 is a perspective view of an electromagnetic relay.
Figure 2:
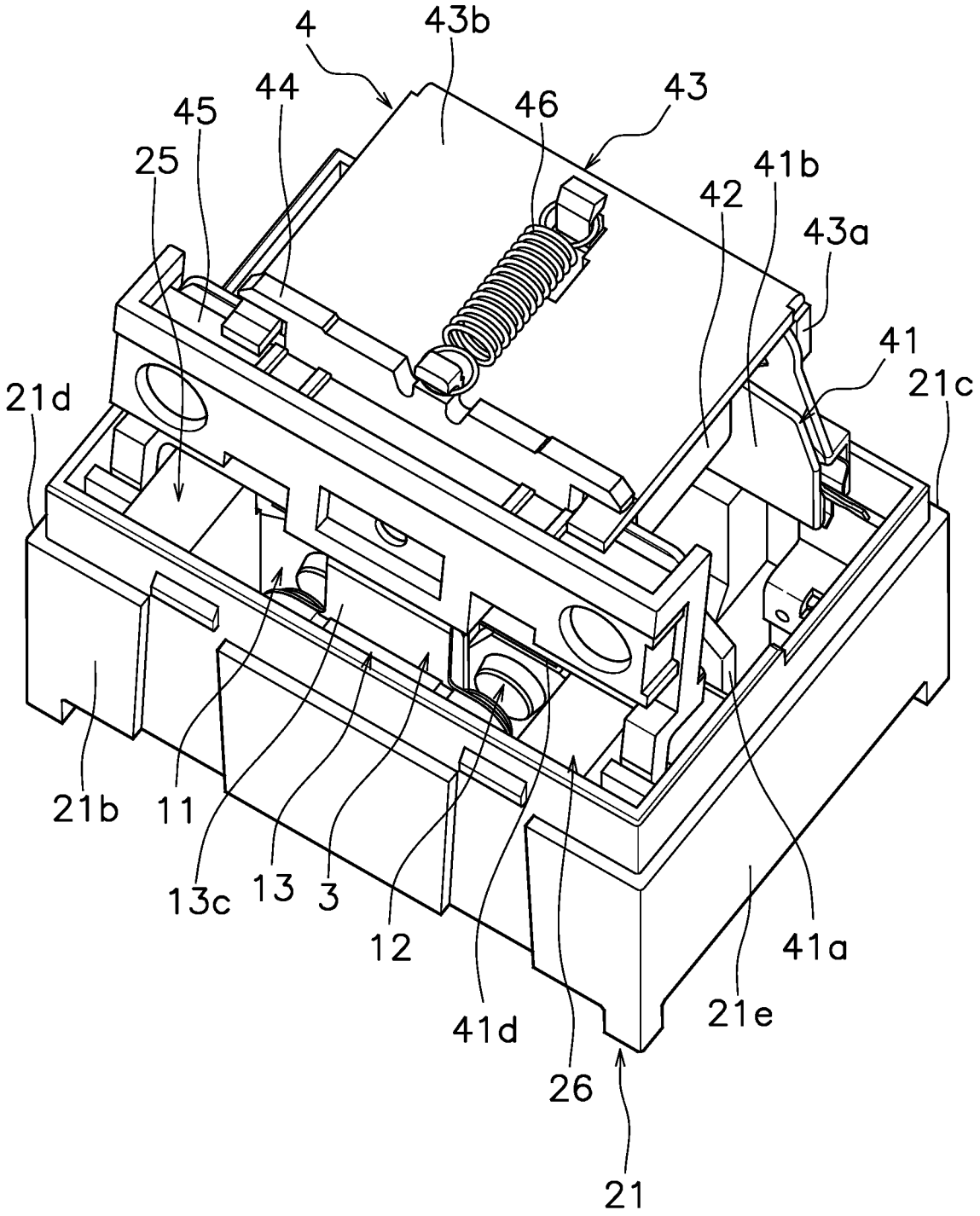
FIG. 2 is a perspective view of an electromagnetic relay with the cover removed.

Hereinafter, an electromagnetic relay 1 according to an embodiment will be described with reference to the drawings. As shown in FIGS. 1 and 2, the electromagnetic relay 1 includes a case 2, a contact device 3, and a drive device 4.

Figure 3:
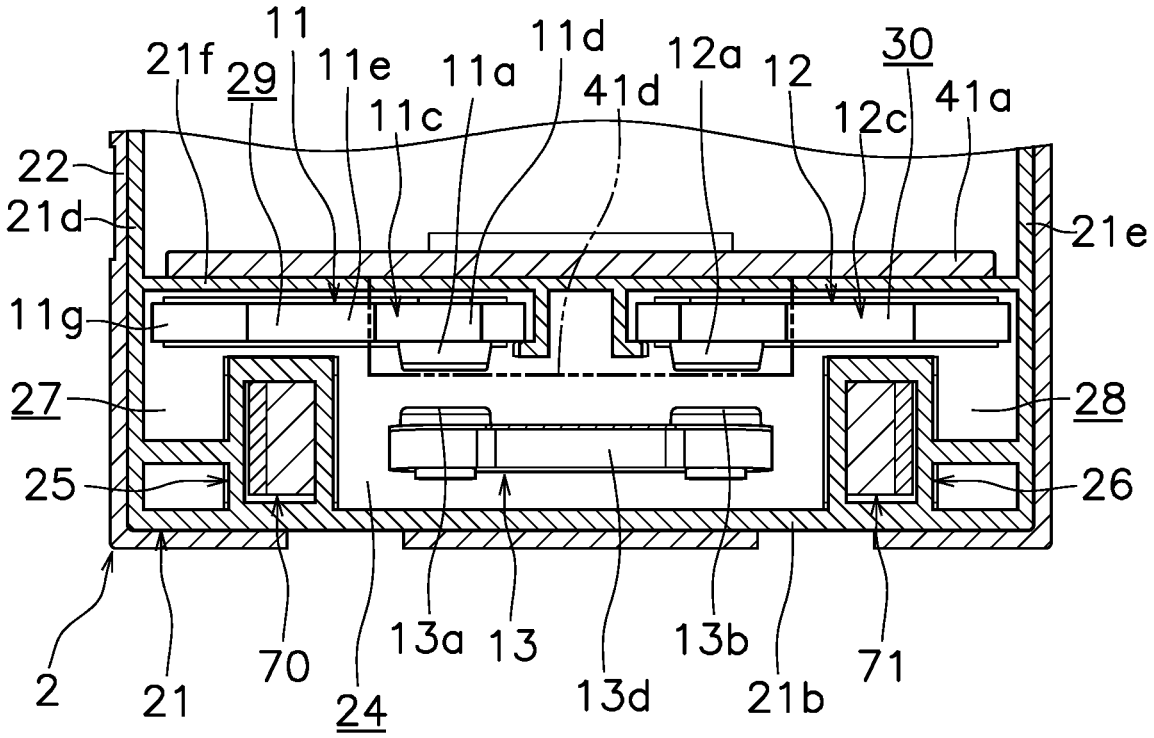
FIG. 3 is a partial cross-sectional view of an electromagnetic relay cut along a plane orthogonal to the up-down direction.

In the following description, the direction in which the contact device 3 and the drive device 4 are disposed with respect to a later-described base 21 of the case 2 is referred to as up (an example of a second direction), and the opposite direction is referred to as down (an example of a first direction). The direction in which the contact device 3 is disposed with respect to the drive device 4 is referred to as front, and the opposite is referred to as back. The left-right direction of the paper of FIG. 3 is referred to as left-right. However, these directions are defined only for convenience of description, and do not limit the arrangement directions of the electromagnetic relay 1.

The case 2 has a box shape. The case 2 is made of an insulating material such as resin. The case 2 includes a base 21 and a cover 22. The base 21 supports the contact device 3 and the drive device 4. The base 21 includes a bottom 21*a*, outer walls 21*b* to 21*e*, and an inner wall 21*f* (see FIG. 3). The bottom 21*a* extends in a direction orthogonal to the up-down direction. The outer wall 21*b* extends upward from the front edge of the bottom 21*a*. The outer wall 21*c* extends upward from the back edge of the bottom 21*a*. The outer wall 21*d* extends upward from the left edge of the bottom 21*a*. The outer wall 21*e* extends upward from the right edge of the bottom 21*a*. The inner wall 21*f* extends upward from the bottom 21*a*. The inner wall 21*f* extends in the left-right direction between the outer wall 21*d* and the outer wall 21*e*. The inner wall 21*f* is disposed between the contact device 3 and the drive device 4 in the front-back direction.

The cover 22 is open downward and is attached to the outer walls 21*b* to 21*e* of the base 21 so as to cover the bottom 21*a* of the base 21 from above. The contact device 3 and the drive device 4 are accommodated in the case 2.

As shown in FIG. 3, the contact device 3 includes a first fixed terminal 11, a second fixed terminal 12, and a movable contact piece 13. In the following description, the first fixed terminal 11 and the second fixed terminal 12 may be referred to as fixed terminals 11 and 12.

The fixed terminals 11 and 12 are made of a conductive material such as copper. The fixed terminals 11 and 12 are plate-shaped terminals and extend in a direction orthogonal to the front-back direction. The fixed terminals 11 and 12 are supported by the bottom 21*a* of the base 21. The fixed terminals 11 and 12 are assembled to the base 21 from above. In the present embodiment, the fixed terminals 11 and 12 are fixedly press-fitted to the bottom 21*a* of the base 21. The fixed terminals 11 and 12 are disposed in front of the inner wall 21*f*.

Figure 4:
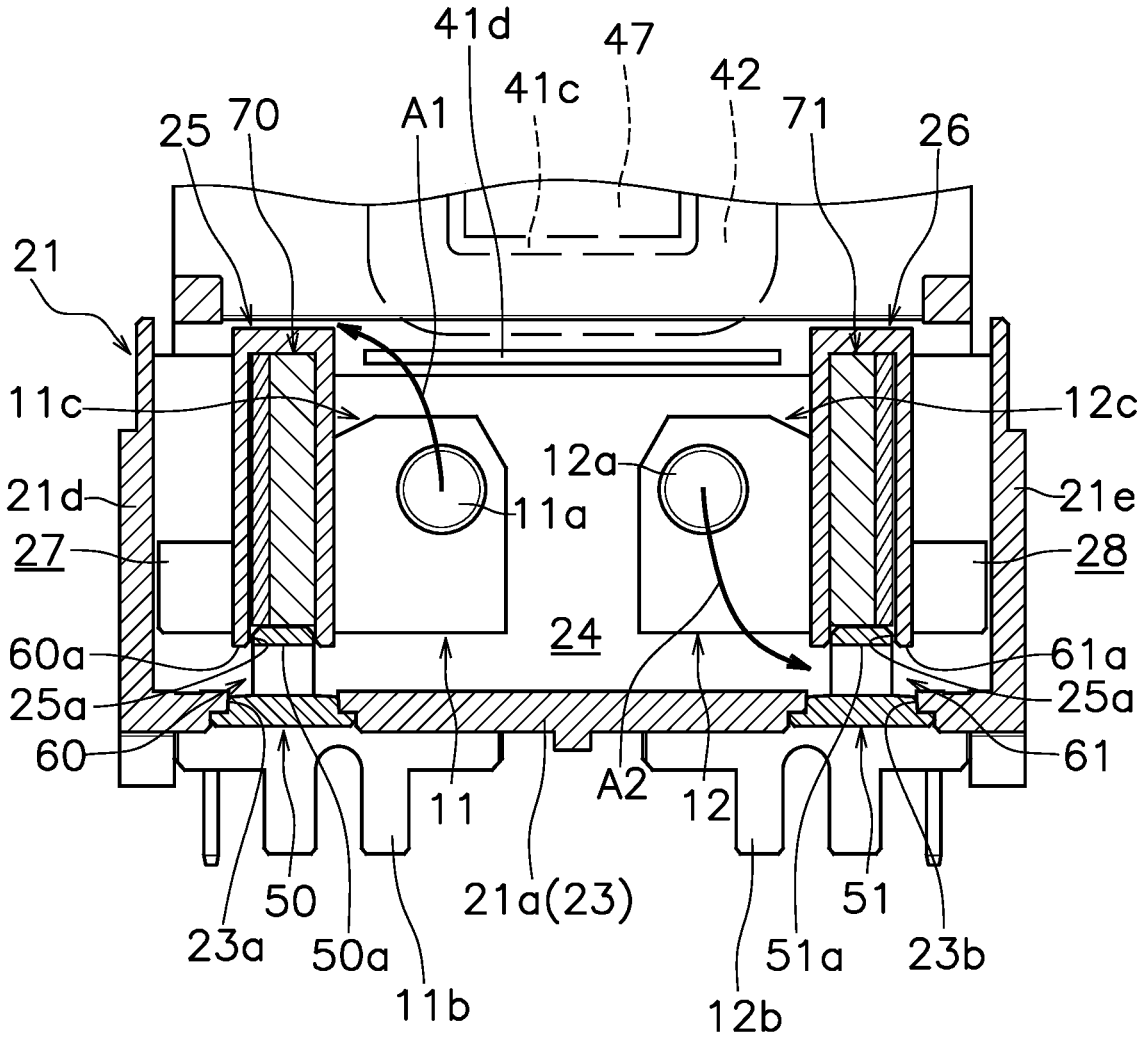
FIG. 4 is a partial cross-sectional view of an electromagnetic relay cut along a plane orthogonal to the front-back direction.
Figure 5:
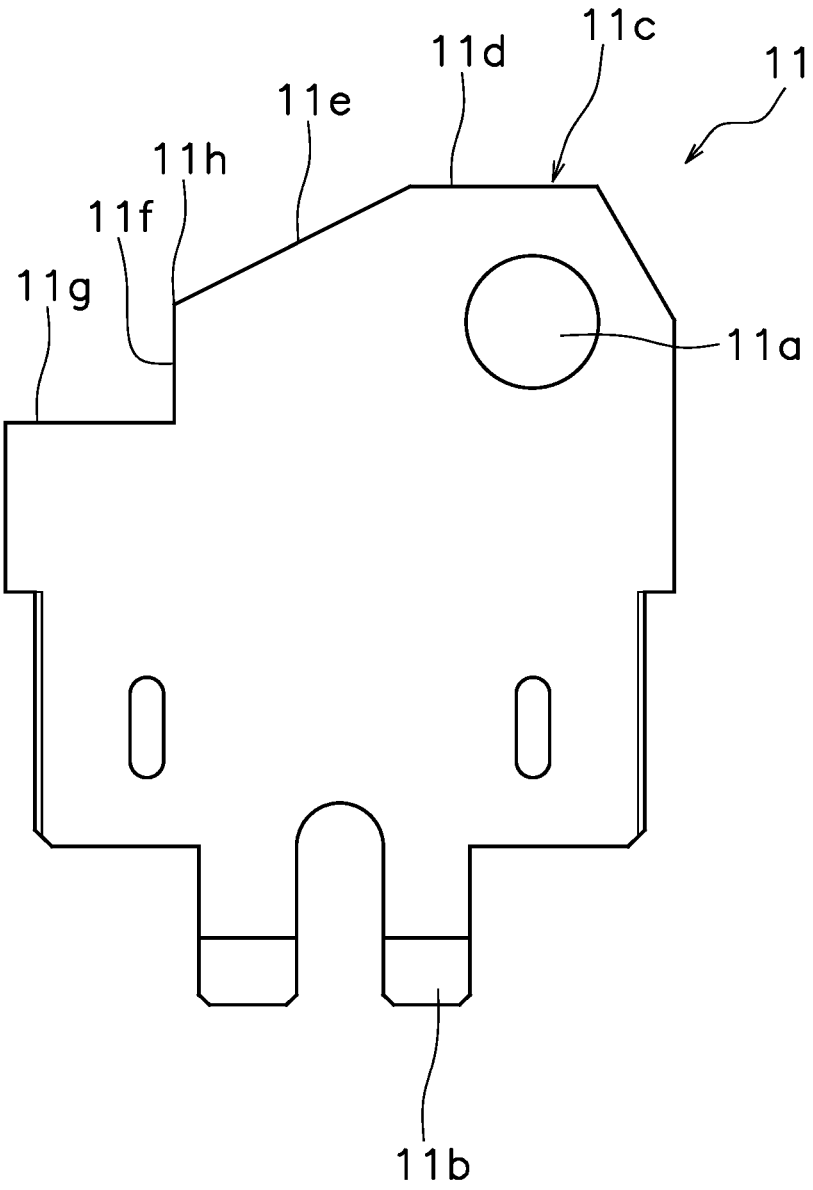
FIG. 5 is a front view of the first fixed terminal.

As shown in FIGS. 3 to 5, the first fixed terminal 11 includes a first fixed contact 11*a*, a first external connecting portion 11*b*, and a first end 11*c*. The first fixed contact 11*a* is disposed on the front surface of the first fixed terminal 11. The first fixed contact 11*a* is fixedly caulked to the first fixed terminal 11. Note that the first fixed contact 11*a* may be integrated with the first fixed terminal 11. The first external connecting portion 11*b* protrudes downward from the bottom 21*a* of the base 21 and is electrically connected to an external device (not shown).

The first end 11*c* is the top end of the first fixed terminal 11. The first end 11*c* is exposed in the case 2. In the present embodiment, the first end 11*c* is entirely exposed in the case 2. The first end 11*c* extends in the left-right direction.

As shown in FIG. 5, the first end 11*c* includes a first flat portion 11*d*, a tapered portion 11*e*, a stepped portion 11*f*, a second flat portion 11*g*, and a corner portion 11*h*. The first flat portion 11*d* is disposed above the first fixed contact 11*a*. The first flat portion 11*d* includes a flat surface orthogonal to the up-down direction. The tapered portion 11*e* is inclined with respect to the first flat portion 11*d* when viewed from the front-back direction. The tapered portion 11*e* extends to the left and downward from the first flat portion 11*d*. The stepped portion 11*f* connects the tapered portion 11*e* and the second flat portion 11*g*. The stepped portion 11*f* extends downward from the left end of the tapered portion 11*e*. The stepped portion 11*f* includes a flat surface orthogonal to the left-right direction. The second flat portion 11*g* extends to the left from the lower end of the stepped portion 11*f*. The second flat portion 11*g* includes a flat surface orthogonal to the up-down direction. The corner portion 11*h* is a corner portion at the boundary between the tapered portion 11*e* and the stepped portion 11*f*.

The second fixed terminal 12 is apart from the first fixed terminal 11 to the right. The second fixed terminal 12 has a symmetrical shape with respect to the first fixed terminal 11. The second fixed terminal 12 includes a second fixed contact 12*a*, a second external connecting portion 12*b*, and a second end 12*c*. The second fixed contact 12*a* is disposed on the front surface of the second fixed terminal 12. The second fixed contact 12*a* is fixedly caulked to the second fixed terminal 12. Note that the second fixed contact 12*a* may be integrated with the second fixed terminal 12. The second external connecting portion 12*b* protrudes downward from the bottom 21*a* of the base 21 and is electrically connected to an external device (not shown). The second end 12*c* has a symmetrical shape with respect to the first end 11*c* of the first fixed terminal 11, and has a similar configuration to that of the first end 11*c* of the first fixed terminal 11. Thus, detailed description of the second end 12*c* will be omitted.

The movable contact piece 13 is a plate-shaped terminal and is made of a conductive material such as copper. The movable contact piece 13 is disposed in front of the fixed terminals 11 and 12. The movable contact piece 13 has a substantially T-shape when viewed from the front-back direction. The movable contact piece 13 includes a first movable contact 13*a*, a second movable contact 13*b*, an up-down extending portion 13*c*, and a left-right extending portion 13*d*.

The first movable contact 13*a* and the second movable contact 13*b* are fixedly caulked to the movable contact piece 13. The first movable contact 13*a* and the second movable contact 13*b* are disposed on the back surface of the left-right extending portion 13*d*. The first movable contact 13*a* faces the first fixed contact 11*a* in the front-back direction. The first movable contact 13*a* is able to be in contact with the first fixed contact 11*a*. The second movable contact 13*b* is apart from the first movable contact 13*a* to the right. The second movable contact 13*b* faces the second fixed contact 12*a* in the front-back direction. The second movable contact 13*b* is able to be in contact with the second fixed contact 12*a*. The first movable contact 13*a* and the second movable contact 13*b* may be integrated with the movable contact piece 13.

The up-down extending portion 13*c* extends in the up-down direction and connected to, at the upper part, the drive device 4. The left-right extending portion 13*d* extends in the left-right direction from the lower part of the up-down extending portion 13*c*.

The drive device 4 is disposed above the contact device 3. The drive device 4 moves the movable contact piece 13 in the direction in which the first movable contact 13*a* approaches the first fixed contact 11*a* and in the direction in which the first movable contact 13*a* separates from the first fixed contact 11*a*. Further, the drive device 4 moves the movable contact piece 13 in the direction in which the second movable contact 13*b* approaches the second fixed contact 12*a* and in the direction in which the second movable contact 13*b* separates from the second fixed contact 12*a*. In the present embodiment, the drive device 4 moves the movable contact piece 13 in the front-back direction (one example of the moving directions).

As shown in FIGS. 2 and 4, the drive device 4 includes a spool 41, a coil 42, a yoke 43, a movable iron piece 44, a resin member 45, a return spring 46, and a fixed iron core.

The spool 41 is disposed above the fixed terminals 11 and 12. The spool 41 includes flange portions 41*a* and 41*b*, a body portion 41*c*, and a collar portion 41*d*. The flange portions 41*a* and 41*b* have an outer diameter larger than the outer diameter of the body portion 41*c*. The flange portion 41*a* is connected to the front end of the body portion 41*c*. The flange portion 41*b* is connected to the back end of the body portion 41*c*. The body portion 41*c* is tubular, and has a coil 42 wound around the outer circumference thereof. The collar portion 41*d* secures a distance for insulation between the fixed terminals 11 and 12 and the fixed iron core 47. As shown in FIGS. 3 and 4, the collar portion 41*d* extends forward from the front surface of the flange portion 41*a*. The collar portion 41*d* is disposed above the fixed terminals 11 and 12. The collar portion 41*d* extends in a direction orthogonal to the up-down direction.

The coil 42 is wound around the outer circumference of the spool 41. The yoke 43 has an L-shaped bent shape. The yoke 43 includes a coupling portion 43*a* and an extending portion 43*b*. The coupling portion 43*a* is disposed behind the spool 41 and is coupled to the fixed iron core 47. The extending portion 43*b* extends forward from the upper end of the coupling portion 43*a* so as to cover the upper part of the coil 42.

The movable iron piece 44 is disposed in front of the fixed iron core 47. The movable iron piece 44 is rotatably supported by the yoke 43 at the front end of the extending portion 43*b*. The resin member 45 insulates the movable iron piece 44 and the movable contact piece 13. The resin member 45 couples the movable iron piece 44 and the movable contact piece 13. Specifically, the movable iron piece 44 and the movable contact piece 13 are made by insert-molding into the resin member 45. Thus, the resin member 45 and the movable contact piece 13 are rotatable integrally with the movable iron piece 44 in response to the rotation of the movable iron piece 44.

The return spring 46 is a coil spring and extends in the front-back direction. The return spring 46 has a front end connected to the movable iron piece 44 and a back end connected to a yoke 43. The return spring 46 forces the movable contact piece 13 forward via the movable iron piece 44 and the resin member 45. That is, the return spring 46 forces the movable contact piece 13 in the direction in which the first movable contact 13*a* separates from the first fixed contact 11*a* and in the direction in which the second movable contact 13*b* separates from the second fixed contact 12*a*. The fixed iron core 47 is disposed in the body portion 41*c* of the spool 41 and penetrates the flange portions 41*a* and 41*b* of the spool 41 in the front-back direction.

Next, the operation of the electromagnetic relay 1 will be described. While no voltage is applied to the coil 42, as shown in FIG. 3, by the elastic force of the return spring 46, the first movable contact 13*a* is separated from the first fixed contact 11*a* and the second movable contact 13*b* is separated from the second fixed contact 12*a*. When a voltage is applied to the coil 42 and the coil 42 is excited, the electromagnetic force causes the movable iron piece 44 to be attracted to the fixed iron core 47, which rotates the movable iron piece 44 against the elastic force of the return spring 46. Consequently, the movable contact piece 13 moves backward, the first movable contact 13*a* contacts the first fixed contact 11*a*, and the second movable contact 13*b* contacts the second fixed contact 12*a*. When the application of the voltage to the coil 42 is stopped, the movable iron piece 44 is rotated by the elastic force of the return spring 46. As a result, the movable contact piece 13 moves forward, the first movable contact 13*a* separates from the first fixed contact 11*a*, and the second movable contact 13*b* separates from the second fixed contact 12*a*.

Here, as shown in FIGS. 3 and 4, the case 2 further includes a side wall 23, an accommodation space 24, magnet housings 25, 26, gas inflow spaces 27, 28, and arc extension spaces 29, 30.

The side wall 23 is configured by the bottom 21*a* of the base 21 in the present embodiment. The side wall 23 covers the accommodation space 24 and the gas inflow spaces 27 and 28 from below. The side wall 23 has through holes 23*a* and 23*b*. The through holes 23*a* and 23*b* penetrate the side wall 23 in the up-down direction. The through hole 23*a* is disposed below the magnet housing 25. The through hole 23*b* is disposed below the magnet housing 26.

The accommodation space 24 is disposed between the base 21 and the cover 22. The accommodation space 24 is between the magnet housing 25 and the magnet housing 26 in the left-right direction. The first fixed contact 11*a*, the second fixed contact 12*a*, and the movable contact piece 13 are accommodated in the accommodation space 24.

The magnet housing 25 is integrally formed with the base 21. The magnet housing 25 extends in the up-down direction and backward from the outer wall 21*b* of the base 21. The magnet housing 25 is disposed upwardly apart from the bottom 21*a* of the base 21. The magnet housing 25 is disposed to the left of the first fixed contact 11*a* and the first movable contact 13*a*. The magnet housing 25 is disposed between the accommodation space 24 and the gas inflow space 27. The magnet housing 25 partitions the accommodation space 24 and the gas inflow space 27 in the left-right direction. The magnet housing 25 extends above the first fixed contact 11*a* and the first movable contact 13*a* with respect to the bottom 21*a* of the base 21. The magnet housing 25 extends above the first fixed terminal 11 with respect to the bottom 21*a* of the base 21.

The magnet housing 25 has an inlet 25*a*. The inlet 25*a* is disposed at the lower end of the magnet housing 25 and opens downward. The inlet 25*a* is disposed above the bottom 21*a* of the base 21. The inlet 25*a* overlaps with the through hole 23*a* when viewed from the up-down direction.

The magnet housing 26 has a symmetrical shape with the magnet housing 25, and detailed description thereof will be omitted. The magnet housing 26 is disposed to the right of the second fixed contact 12*a* and the second movable contact 13*b*. The magnet housing 26 is disposed between the accommodation space 24 and the gas inflow space 28. The magnet housing 26 partitions the accommodation space 24 and the gas inflow space 28 in the left-right direction. The magnet housing 25 has an inlet 26*a*.

The gas inflow spaces 27 and 28 are disposed between the base 21 and the cover 22. The gas inflow spaces 27 and 28 are separate from the accommodation space 24. The gas inflow space 27 is disposed to the left of the accommodation space 24. The gas inflow space 27 is disposed between the magnet housing 25 and the outer wall 21*d* of the base 21 in the left-right direction. The gas inflow space 28 is disposed to the right of the accommodation space 24. The gas inflow space 28 is disposed between the magnet housing 26 and the outer wall 21*e* of the base 21 in the left-right direction.

The arc extension spaces 29, 30 are in communication with the accommodation space 24. The arc extension space 29 is expanded upward from the tapered portion 11*e* of the first end 11*c* of the first fixed terminal 11. The arc extension space 30 expands upward from the tapered portion of the second end 12*c* of the second fixed terminal 12.

The electromagnetic relay 1 includes support members 50 and 51, gas flow paths 60 and 61, a first magnet 70, and a second magnet 71.

The support member 50 is a separate body from the base 21. The support member 50 is, for example, fixedly press-fitted to the bottom 21*a* of the base 21. The support member 50 closes the inlet 25*a* of the magnet housing 25 and the through hole 23*a* of the side wall 23. The support member 50 supports the first magnet 70 from below. The support member 50 has a through hole 50*a* penetrating it in the left-right direction.

The support member 51 closes the inlet 26*a* of the magnet housing 26 and the through hole 23*b* of the side wall 23. The support member 51 has a through hole 51*a*. The support member 51 has a similar configuration to that of the support member 50, and detailed description thereof will be omitted.

The gas flow path 60 is disposed between the side wall 23 of the case 2 and the first magnet 70. The gas flow path 60 extends in the left-right direction and communicates the accommodation space 24 with the gas inflow space 27. The gas flow path 60 is disposed below the first magnet 70. The gas flow path 60 is configured by a through hole 60*a* and the through hole 50*a* of the support member 50. The through hole 60*a* penetrates between the magnet housing 25 and the side wall 23 in the left-right direction. The through hole 60*a* is formed to be continuous to the through hole 50*a* of the support member 50 in the left-right direction.

The gas flow path 61 is disposed between the side wall 23 of the case 2 and the second magnet 71. The gas flow path 61 extends in the left-right direction and communicates the accommodation space 24 with the gas inflow space 28. The gas flow path 61 is disposed below the second magnet 71. The gas flow path 61 is configured by a through hole 61*a* and the through hole 51*a* of the support member 51.

The through hole 61*a* penetrates between the magnet housing 26 and the side wall 23 in the left-right direction. The through hole 61*a* is formed to be continuous to the through hole 51*a* of the support member 51 in the left-right direction.

The first magnet 70 is, for example, a rectangular permanent magnet. The first magnet 70 is disposed to the left of the first fixed contact 11*a* and the first movable contact 13*a*. The first magnet 70 is housed in a magnet housing 25. The first magnet 70 is inserted into the magnet housing 25 from below. In the present embodiment, the first magnet 70 is configured by a magnet body and a yoke disposed to the left of the magnet body.

Figure 6:
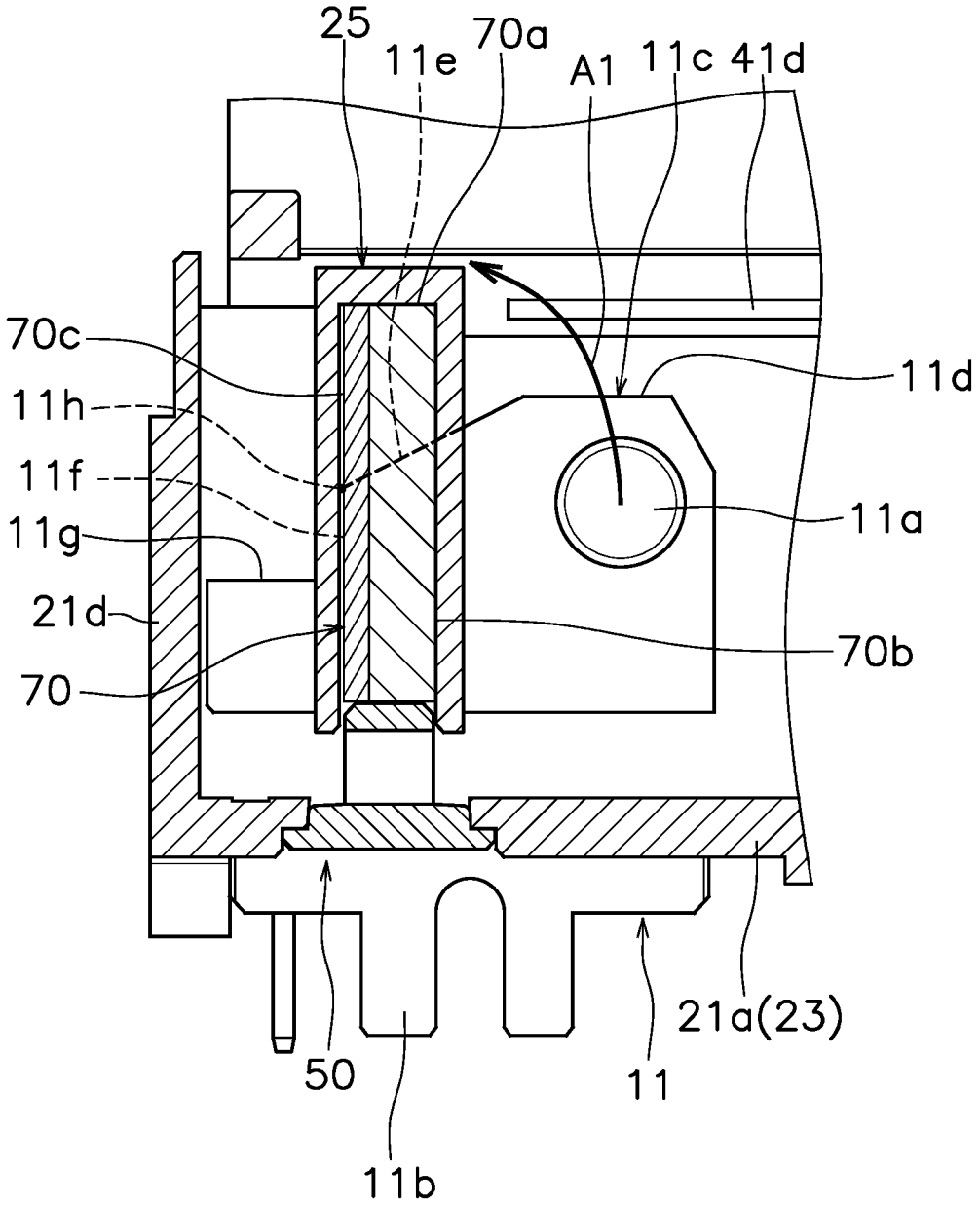
FIG. 6 is an enlarged view the periphery of the first fixed terminal in FIG. 4.

As shown in FIG. 6, the first magnet 70 overlaps with the first fixed terminal 11 when viewed from the front-back direction. The first magnet 70 includes a magnet end 70*a*. The magnet end 70*a* is the upper end of the first magnet 70. The magnet end 70*a* is disposed above the first fixed contact 11*a*. The magnet end 70*a* is disposed above the first end 11*c* of the first fixed terminal 11.

The first magnet 70 includes a first surface 70*b* and a second surface 70*c* opposite the first surface 70*b*. The first surface 70*b* is a surface of the first magnet 70 in the direction from the first fixed contact 11*a* toward the second fixed contact 12*a*.

The first magnet 70 is disposed so that the magnetic flux in the vicinity of the first fixed contact 11*a* flows to the left. The first magnet 70 extends upward an arc A1 generated between the first fixed contact 11*a* and the first movable contact 13*a*. Specifically, for example, when a current flows from the first movable contact 13*a* toward the first fixed contact 11*a*, an upward Lorentz force acts on the arc A1, and the arc A1 is extended upward. As shown in FIG. 4, as extended upward, the arc A1 is extended to be drawn to the magnet end 70*a*.

The second magnet 71 is disposed to the right of the second fixed contact 12*a* and the second movable contact 13*b*. The second magnet 71 is housed in the magnet housing 26. The second magnet 71 overlaps with the second fixed terminal 12 when viewed from the front-back direction.

The second magnet 71 is disposed so that the magnetic flux in the vicinity of the second fixed contact 12*a* flows to the left. The second magnet 71 is disposed to face the first magnet 70 at the different poles each other. The second magnet 71 extends downward an arc A2 generated between the second fixed contact 12*a* and the second movable contact 13*b*. Specifically, for example, when a current flows from the second fixed contact 12*a* toward the second movable contact 13*b*, a downward Lorentz force acts on the arc A2, and the arc A2 is extended downward. As shown in FIG. 4, as extended downward, the arc A2 is extended to be drawn to the lower end of the second magnet 71.

As shown in FIG. 6, the tapered portion 11*e* of the first end 11*c* of the first fixed terminal 11 is inclined downward from the first fixed contact 11*a* toward the first magnet 70. At least a part of the tapered portion 11*e* overlaps with the first magnet 70 when viewed from the front-back direction. The tapered portion 11*e* extends in the right direction (one example of the third direction) with respect to the first surface 70*b* of the first magnet 70 when viewed from the front-back direction. The tapered portion 11*e* extends to the right with respect to the magnet housing 25 when viewed from the front-back direction. The corner portion 11*h* of the first end 11*c* of the fixed terminal 11 is disposed in the vicinity of the second surface 70*c* of the first magnet 70 when viewed from the front-back direction.

As shown in FIG. 3, at least a part of the tapered portion 11*e* does not overlap with the collar portion 41*d* of the spool 41 when viewed from the up-down direction. In the present embodiment, most of the tapered portion 11*e* is exposed from the collar portion 41*d* of the spool 41 when viewed from the up-down direction. The corner portion 11*h* of the first end 11*c* of the first fixed terminal 11 is disposed in the vicinity of the second surface 70*c* of the first magnet 70 when viewed from the front-back direction. The corner portion 11*h* is disposed at a position closer to the second surface 70*c* than the first surface 70*b* of the first magnet 70 when viewed from the front-back direction. The corner portion 11*h* is disposed at a position overlapping one of the first magnet 70 and the magnet housing 25 when viewed from the front-back direction.

As shown in FIGS. 4 and 6, the collar portion 41*d* of the spool 41 is disposed to the right with respect to the first magnet 70. The collar portion 41*d* overlaps with the first flat portion 11*d* and the first fixed contact 11*a* when viewed from the up-down direction. The collar portion 41*d* is disposed between the first magnet 70 and the second magnet 71 when viewed from the front-back direction. The collar portion 41*d* is disposed only between the first magnet 70 and the second magnet 71 in the left-right direction. The collar portion 41*d* is disposed between the magnet housing 25 and the magnet housing 26 in the left-right direction. The collar portion 41*d* has a lateral dimension smaller than the dimension between the first magnet 70 and the second magnet 71.

In the electromagnetic relay 1 described above, the arc A1 generated between the first fixed contact 11*a* and the first movable contact 13*a* is extended upward. That is, the bright spot of arc A1 moving on the first fixed terminal 11 moves to the first end 11*c*. The bright spot of the arc A1 that has moved to the first end 11*c* is guided by the tapered portion 11*e* of the first end 11*c*, and easily moves to the back side of the first magnet 70 and moves downward. Thus, the arc A1 can be significantly extended in the arc extension space 29, which expands upward from the tapered portion 11*e*, so that the arc A1 can be quickly cut off. As a result, the possibility of re-ignition of the arc A1 can be reduced.

The collar portion 41*d* of the spool 41 is disposed between the first magnet 70 and the second magnet 71 when viewed from the front-back direction. Thus, for example, compared with the case where the collar portion 41*d* extends to a position overlapping with the first magnet 70, the arc A1 is more limited from hitting the collar portion 41*d*. As a result, the collar portion 41*d* is less likely to be affected by the arc, enhancing the durability of the collar portion 41*d*. In addition, since the extension of the arc A1 is less likely to be hindered by the collar portion 41*d*, the arc A1 can be quickly cut off in the arc extension space 29.

In the present embodiment, the hot gas due to the arc A2 can be released from the accommodation space 24 to the gas inflow space 28 through the gas flow path 61, reducing the possibility of re-ignition of the arc A2.

The first end 11*c* of the first fixed terminal 11 includes the first flat portion 11*d* and the second flat portion 11*g*, and thereby the first fixed terminal 11 can be easily press-fitted to the base 21 from above. Further, since the first end 11*c* includes the corner portion 11*h*, the movement of the bright spot of the arc A1 on the first fixed terminal 11 can be stopped at the corner portion 11*h*. Thus, the arc A1 is limited from being too far from the movable contact piece 13. As a result, the phenomenon of re-ignition of the arc A1 due to its interruption is less likely to occur.

One embodiment of the present invention has been described above, but the present invention is not limited to the above embodiment, and various modifications can be made without departing from the gist of the invention.

The configurations of the contact device 3 and the drive device 4 may be modified. For example, the configuration of first fixed terminal 11 may be changed. The first external connecting portion 11*b* may protrude from the outer wall 21*d* of the base 21. The first end 11*c* may include at least the tapered portion 11*e*. The entire tapered portion 11*e* may overlap with the first magnet 70 when viewed from the front-back direction. The tapered portion 11*e* may extend to the outer wall 21*d*. The position of the corner portion 11*h* may be changed. The drive device 4 may have a plunger type structure.

REFERENCE NUMERALS

1 Electromagnetic relay
2 Case
4 Drive device
11 First fixed terminal
11*a* First fixed contact
11*c* First end
11*e* Tapered portion
12 Second fixed terminal
12*a* Second fixed contact
13 Movable contact piece
13*a* First movable contact
13*b* Second movable contact
23 Side wall
24 Accommodation space
29 Arc extension space
41*d* Collar portion
70 First magnet
70*a* Magnet end

The invention claimed is:

1. An electromagnetic relay comprising:

a first fixed terminal including a first fixed contact;

a second fixed terminal disposed apart from the first fixed terminal, the second fixed terminal including a second fixed contact;

a movable contact piece including a first movable contact facing the first fixed contact and a second movable contact facing the second fixed contact;

a case including an accommodation space and a side wall, the accommodation space accommodating the first fixed contact, the second fixed contact and the movable contact piece, the side wall covering the accommodation space in a first direction;

a drive device configured to move the movable contact piece in moving directions including a direction in which the first movable contact approaches the first fixed contact and a direction in which the first movable contact separates from the first fixed contact; and a first magnet disposed laterally to the first fixed contact, the first magnet being configured to extend an arc generated between the first fixed contact and the first movable contact in a second direction opposite to the first direction, wherein the first fixed terminal includes a first end in the second direction, the first end of the first fixed terminal includes a tapered portion inclined from the first fixed contact toward the first magnet in the second direction, the tapered portion at least partially overlapping with the first magnet when viewed from the moving directions, and the case includes an arc extension space expanding from the tapered portion in the second direction, the arc extension space communicating with the accommodation space.

2. The electromagnetic relay according to claim 1, wherein the first fixed terminal includes a first external connecting portion protruding from the side wall in the first direction, and the second fixed terminal includes a second external connecting portion protruding from the side wall in the first direction.

3. The electromagnetic relay according to claim 1, wherein the first magnet includes a magnet end in the second direction, and the magnet end of the first magnet is disposed in the second direction with respect to the first fixed contact.

4. The electromagnetic relay according to claim 1, wherein the first magnet includes a first surface in a third direction extending from the first fixed contact toward the second fixed contact and a second surface opposite the first surface, the tapered portion protrudes from the first surface of the first magnet in the third direction when viewed from the moving directions.

5. The electromagnetic relay according to claim 1, wherein the first magnet has a first surface in a third direction extending from the first fixed contact toward the second fixed contact and a second surface opposite to the first surface, and the first end of the first fixed terminal includes a corner portion disposed adjacent to the second surface of the first magnet when viewed from the moving directions, the corner portion being connected to the tapered portion.

6. The electromagnetic relay according to claim 1, wherein the first end of the first fixed terminal includes a first flat portion and a second flat portion apart from the first flat portion, and the tapered portion is disposed between the first flat portion and the second flat portion.

7. The electromagnetic relay according to claim 1, wherein the drive device includes a spool and a fixed iron core disposed inside the spool, the fixed iron core being disposed in the second direction with respect to the first fixed terminal, the spool includes a collar portion configured to provide an insulating distance between the first fixed terminal and the fixed iron core, and the collar portion of the spool is disposed in a third direction extending from the first fixed contact toward the second fixed contact with respect to the first magnet.

8. The electromagnetic relay according to claim 7, further comprising a second magnet disposed opposite to the first magnet and laterally to the first fixed contact, the second magnet being configured to extend an arc generated between the second fixed contact and the second movable contact, wherein the collar portion of the spool is disposed between the first magnet and the second magnet when viewed from the moving directions.

* * * * *